US008601927B2

(12) United States Patent
Geiss

(10) Patent No.: US 8,601,927 B2
(45) Date of Patent: Dec. 10, 2013

(54) DEVICE FOR ULTRASONIC MACHINING, MACHINE TOOL AND MACHINE TOOL APPARATUS

(75) Inventor: Manfred Geiss, Sesslach (DE)

(73) Assignee: Geiss AG, Sesslach (DE)

( * ) Notice: Subject to any disclaimer, the term of this patent is extended or adjusted under 35 U.S.C. 154(b) by 558 days.

(21) Appl. No.: 12/712,468

(22) Filed: Feb. 25, 2010

(65) Prior Publication Data

US 2011/0126685 A1 Jun. 2, 2011

(30) Foreign Application Priority Data

Nov. 30, 2009 (EP) ..... 09177534
Nov. 30, 2009 (EP) ..... 09177535

(51) Int. Cl.
*B26D 5/08* (2006.01)

(52) U.S. Cl.
USPC ..... 83/613; 83/698.21

(58) Field of Classification Search
USPC ..... 83/698.21, 663, 613; 604/20, 22; 451/165, 11, 119, 155, 156, 450, 488
See application file for complete search history.

(56) References Cited

U.S. PATENT DOCUMENTS

| | | | | |
|---|---|---|---|---|
| 3,034,431 | A * | 5/1962 | Pannier | 101/389.1 |
| 3,482,360 | A | 12/1969 | Legge | 451/24 |
| 3,545,044 | A * | 12/1970 | Morrison et al. | 425/3 |
| 3,731,564 | A | 5/1973 | Diener et al. | 82/148 |
| 5,009,554 | A | 4/1991 | Kameyama et al. | 409/231 |
| 5,351,376 | A | 10/1994 | Kitamura | 29/27 C |
| 5,505,109 | A * | 4/1996 | Okonski et al. | 83/622 |
| 6,227,777 | B1 | 5/2001 | Kosmowski | 409/231 |
| 2003/0084554 | A1 | 5/2003 | Geissler et al. | 29/27 C |
| 2006/0128283 | A1 * | 6/2006 | Fiebelkorn et al. | 451/165 |
| 2006/0229004 | A1 | 10/2006 | Ohnishi | 451/165 |
| 2007/0059116 | A1 | 3/2007 | Brunemann | 409/201 |
| 2007/0264093 | A1 * | 11/2007 | White et al. | 408/127 |
| 2008/0217870 | A1 * | 9/2008 | Shibata | 279/82 |
| 2010/0158307 | A1 | 6/2010 | Kubota et al. | 381/400 |

FOREIGN PATENT DOCUMENTS

| | | |
|---|---|---|
| DE | 4119752 | 6/1991 |
| DE | 4431375 | 8/1994 |
| DE | 69705572 | 4/1997 |
| DE | 10004062 | 1/2000 |
| DE | 10301433 | 7/2004 |
| DE | 10316789 | 10/2004 |
| DE | 10300042 | 1/2005 |
| DE | 69918114 | 7/2005 |
| DE | 202005009096 | 11/2006 |

(Continued)

OTHER PUBLICATIONS

Examination Report from corresponding European Patent Application No. 09 177 535.3, dated Jan. 20, 2012, 3 pages.

(Continued)

*Primary Examiner* — Ghassem Alie
(74) *Attorney, Agent, or Firm* — Westman, Champlin & Koehler, P.A.

(57) ABSTRACT

A device for ultrasonic machining includes a sonotrode for machining material. Further, the device for ultrasonic machining includes an armature for connecting the device to a machine tool in a releasably magnetic manner. In an embodiment, the device further includes a transducer which is connectable to a power supply at the machine tool to receive electrical energy and is connected to the sonotrode for introducing mechanical vibrations into the sonotrode.

10 Claims, 1 Drawing Sheet

(56) References Cited

FOREIGN PATENT DOCUMENTS

| | | | | |
|---|---|---|---|---|
| DE | 102007041931 | | | 3/2009 |
| EP | 0287374 | | | 4/1988 |
| EP | 0353415 | | | 5/1989 |
| EP | 0665083 | | | 10/1994 |
| EP | 0 820 841 | A1 | | 7/1997 |
| EP | 0820841 | | | 7/1997 |
| EP | 1 074 338 | A2 | | 7/2000 |
| EP | 1 589 317 | A1 | | 4/2004 |
| EP | 1 932 636 | A1 | | 7/2006 |
| FR | 2735412 | | | 6/1995 |
| GB | 2241460 | | * | 5/1990 |
| JP | 60127968 | | | 7/1985 |
| JP | 60-172432 | | | 9/1985 |
| JP | 63139647 | | | 6/1988 |
| JP | 63139649 | | | 6/1988 |
| JP | 02212097 | | | 8/1990 |
| JP | 07132493 | | | 5/1995 |
| JP | 408132153 | A | * | 5/1996 |
| JP | 2007007810 | A | | 1/2007 |
| WO | WO2008/041065 | | | 4/2008 |
| WO | WO2008/087525 | | | 7/2008 |

OTHER PUBLICATIONS

"Praxis der Antriebstechnik Band 7 Servo-Antrieve Grundlagen, Eigenschaften, Projektierung," Dec. 31, 1997, 26 pages.

EP Search Report for corresponding Serial No. 09177534.6, dated May 11, 2010.

EP Search Report for corresponding Serial No. 09177535.3, dated May 25, 2010.

ATC "XChange" "XC-120" Users Guide Maintenance & Instruction Manual, Nitta Corporation, '08. 03 Rev. 1, 28 pages.

* cited by examiner

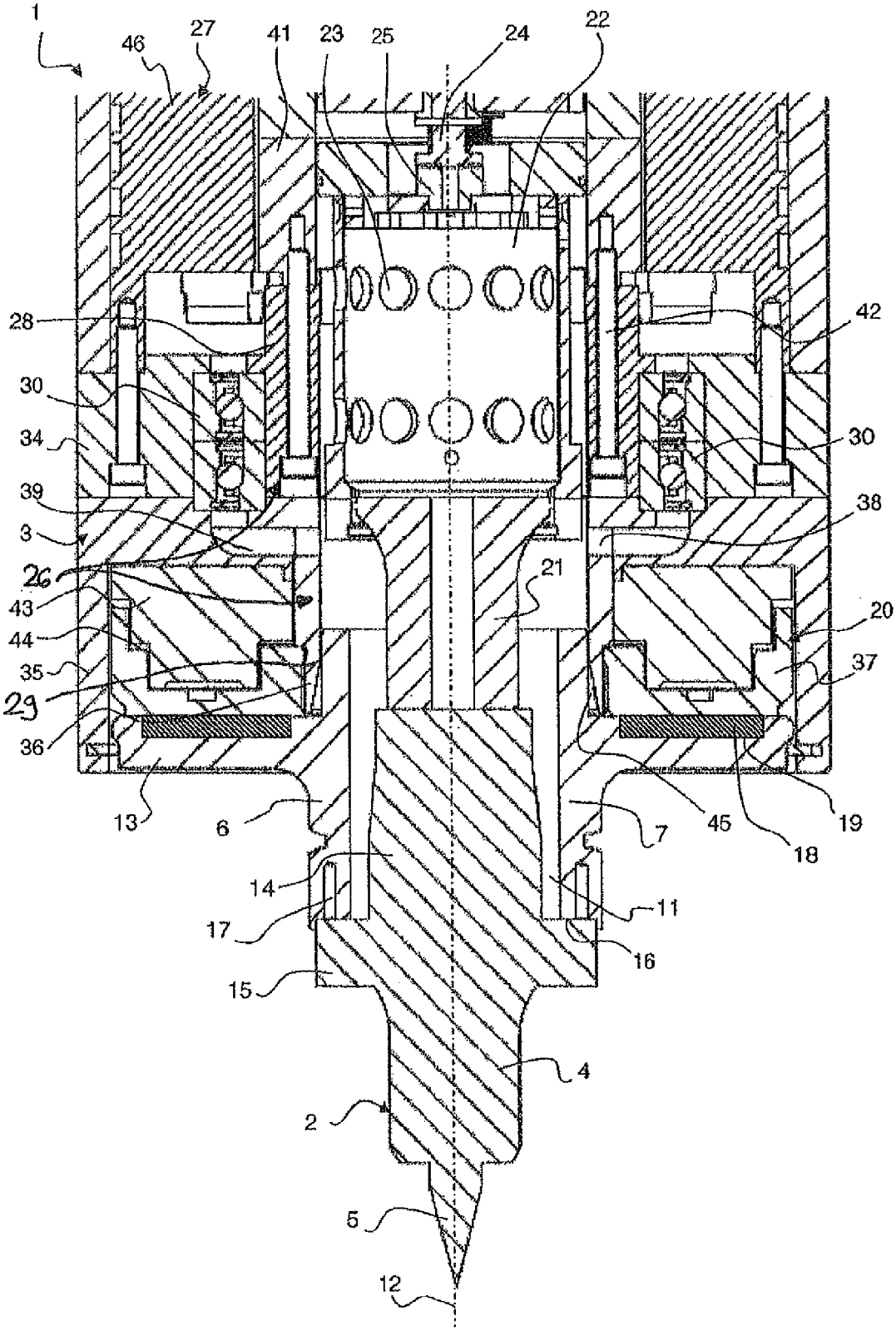
1
46
27
41
23
25
24
22
28
42
30
34
30
39
38
3
26
21
43
20
44
35
37
29
36
13
6
45
19
7
18
14
11
17
16
15
4
2
5
12

DEVICE FOR ULTRASONIC MACHINING, MACHINE TOOL AND MACHINE TOOL APPARATUS

CROSS-REFERENCE TO OTHER APPLICATIONS

This application claims the benefit of European Patent Applications No. EP 09177534.6 and No. EP 09177535.3, both filed on Nov. 30, 2009, the entire disclosures of which are herein incorporated.

FIELD OF THE INVENTION

The present invention relates to a device for ultrasonic machining, a machine tool and a machine tool apparatus.

BACKGROUND OF THE INVENTION

In particular, the cutting of thin and/or soft materials, e.g. plastics, by means of a sonotrode to which ultrasound is applied is commonly known. The sonotrodes used therein comprise a blade that oscillates in its longitudinal direction due to the ultrasound. This results in the cutting forces being significantly reduced when compared to a blade that is only moved in the direction of cutting, thereby avoiding unintentionally moving or puckering the material.

Different materials to be cut require sonotrodes of different designs. In some instances this requires exchanging the sonotrodes frequently. According to one approach known to the inventors the sonotrodes are releasably connected to a corresponding machine tool for moving the sonotrodes by means of a mechanical coupling. However, releasing and reconnecting the mechanical coupling is rather time-consuming. Further, such mechanical couplings tend to take up a lot of space.

SUMMARY OF THE INVENTION

A device for ultrasonic machining is provided, the device comprising: a sonotrode for machining material; and an armature for connecting the device to a machine tool in a releasably magnetic manner.

Further, there is provided a machine tool being connectable to the device for ultrasonic machining according to the invention in a releasably magnetic manner.

Further, there is provided a machine tool apparatus, comprising a machine tool according to the invention and a device for ultrasonic machining according to the invention, wherein the machine tool and the device for ultrasonic machining are connected to each other in a releasably magnetic manner.

One idea of the present invention is that a magnetic coupling, i.e. a releasably magnetic lock, is provided between the device for ultrasonic machining and the machine tool. This lock can be configured so as to be sufficient to take up all acting machining loads, in particular also such loads resulting from rotating the device for ultrasonic machining at high speeds around its longitudinal axis.

This type of magnetic coupling can be released and reconnecting quickly and effortlessly. Further, a magnetic coupling tends to take up little space.

Presently, a "sonotrode" refers to a tool which, by inducing high frequency mechanical waves (ultrasound) into the tool, is caused to resonate. The sonotrode provides the connection between the transducer and the work piece and adjusts the ultrasound to the task at hand.

Presently, a "machine tool" refers to any type of machine that is configured to provide relative movement between the device for ultrasonic machining and the work piece.

According to a preferred embodiment of the device for ultrasonic machining of the invention the armature is formed as a ring of magnetic or magnetizable material. This helps to achieve a defined orientation of the device for ultrasonic machining in relation to the machine tool.

According to a preferred embodiment of the device for ultrasonic machining of the invention the device further comprises a transducer being connectable to a power supply at the machine tool to receive electrical energy and being connected to the sonotrode for inducing mechanical vibrations into the sonotrode, wherein the transducer is configured to convert the electrical energy into mechanical energy. According to this embodiment the transducer, the sonotrode and the armatune are to form a single unit that can be replaced altogether when another material is to be cut and therefore a different sonotrode is required. This has the advantage that the components, i.e. the transducer, the sonotrode and the armature, of every device for ultrasonic machining can be matched to one another in order to optimize resonance. This kind of matching may be required since, for example, different sonotrodes may require different transducers and/or different armatures.

According to a preferred embodiment of the device for ultrasonic machining of the invention the device comprises a mounting to which the sonotrode and the armature are mounted. On the one hand, this simplifies manufacturing of the device for ultrasonic machining since the mounting—unlike the sonotrode—may be manufactured from standard materials. On the other hand, by way of this embodiment a worn sonotrode may be replaced at low cost while the mounting remains in the device for ultrasonic machining. According to this embodiment the mounting also forms a part of the replaceable unit referred to earlier. Therefore, the mounting may also be matched for optimum resonance. Preferably, the mounting is formed as a receptable.

It is also considered to form the sonotrode and the mounting in one piece.

According to a preferred embodiment of the device for ultrasonic machining of the invention the mounting comprises a flange extending substantially radially in relation to the longitudinal axis of the sonotrode to which the armature is mounted. This simplifies positioning of the device for ultrasonic machining in relation to a shaft of the machine tool for rotating the device for ultrasonic machining about its longitudinal axis.

According to a preferred embodiment of the device for ultrasonic machining of the invention the mounting is formed with a through-hole. It is further preferred that the sonotrode extends at least partially through the through-hole. This provides an arrangement where the sonotrode and/or the transducer extend into the machine tool when the device for ultrasonic machining is magnetically connected to the machine tool. This may save space.

According to a preferred embodiment of the device for ultrasonic machining of the invention the transducer is arranged outside the through-hole. Thereby, the transducer may be easily connected to corresponding electrical contacts when the device for ultrasonic machining is magnetically connected to the machine tool.

According to a preferred embodiment of the machine tool of the invention the machine tool has a stationary device for magnetizing and a rotatable rotor, wherein the rotor is configured for contacting the anchor of the device for ultrasonic machining and the device for magnetizing is configured to magnetize the rotor and the armature for connecting these to each other.

According to a preferred embodiment of the machine tool of the invention the device for magnetizing comprises a coil. On the other hand, the device for magnetizing may comprise a permanent-magnet.

According to a preferred embodiment of the machine tool of the invention a gap in the form of a labyrinth is formed between the coil and the rotor. Thereby, a stronger magnetic field can be produced inside the rotor.

According to a preferred embodiment of the machine tool of the invention the rotor is connected to a shaft for rotating the device for ultrasonic machining in a rotationally locked manner. Thereby, for example, a sonotrode comprising a circular blade may be moved in a way so as to rotate the blade at a high speed around its longitudinal axis. Preferably, the longitudinal axis is also the one along which the device for ultrasonic oscillates.

According to a preferred embodiment of the machine tool of the invention the shaft is connected to a driving device for driving the shaft. The driving device is preferably configured as a permanent-magnet motor having a rotating field. Preferably, the permanent-magnet motor provides a high torque. Such permanent-magnet motors are referred to as torque motors. This obviates the necessity to provide a gearbox or the like between the motor and the shaft. Such drives are also referred to as "direct drives".

BRIEF DESCRIPTION OF THE DRAWINGS

The invention is further described by way of example with reference to the accompanying FIGURE.

The FIGURE shows a section view of a part of a machine tool apparatus according to an embodiment of the present invention.

In the FIGURE, the same reference numbers refer to the same or functionally equivalent components unless stated otherwise.

DETAILED DESCRIPTION OF THE DRAWINGS

The FIGURE shows a section view of a part of a machine tool apparatus 1 according to an embodiment of the present invention.

The machine tool apparatus 1 is comprised of a device for ultrasonic machining 2 and a machine tool 3, wherein the latter is only shown partially.

The device for ultrasonic machining 2 comprises a sonotrode 4, which has a blade 5 for cutting plastics, for example.

The device for ultrasonic machining 2 further comprises a mounting 6. The mounting 6 comprises a portion 7 in the shape of a bushing, the portion 7 having a through-hole 11. A flange 13 extending radially with respect to the longitudinal axis 12 of the sonotrode 4 connects to the portion 7.

The sonotrode 4 has a first portion 14 extending upwards into the through-hole 11 and has a second portion 15 extending downwards and outside the through-hole 11, the second portion 15 being flanged to a lower face 16 of the portion 7 of the mounting 6, for example by means of screws 17. The second portion 15 of the sonotrode 4 carries the blade 5 at its lower end.

An armature 18 is fixedly connected to the flange 13 of the mounting 6. The armature can be made from steel and, preferably, has a ring shape. The armature 18 is set into a recess 19 in the upper side of the flange 13. The armature 18 is configured to interact with a device for magnetizing 20 of the machine tool 3—which is described in more detail at a later stage—to release the device for ultrasonic machining 2 from the machine tool 3 or to fixedly connect the device for ultrasonic machining 2 to the machine tool 3. The FIGURE shows the device for ultrasonic machining 2 and the machine tool 3 in the fixedly connected state.

A coupling piece 21 of the device for ultrasonic machining 2 connects to the first portion 14 of the sonotrode 4 and extends upwardly therefrom. The coupling piece 21 connects a transducer 22 of the device for ultrasonic machining 2 to the sonotrode 4.

The transducer 22 may comprise a plurality of openings for cooling 23. The transducer 22 is only connected to the machine tool 3 via a pin 24 at its upper end, the pin 24 being movably along the longitudinal axis 12. The pin 24 is urged by means of a spring (not shown) along the longitudinal axis 12 against a contact element 25 of the transducer 22. Electrical energy is transferred from the machine tool 3 to the transducer 22 via the pin 24 and the contact elements 25. The transducer 22 converts the electrical energy into ultrasonic waves and transmits the waves to the sonotrode 4 via the coupling element 21. The resulting oscillation of the blade 5 along the longitudinal axis 12 helps cutting more easily through plastics, for example.

The transducer 22 and the coupling element 21 extend upwardly into the machine tool 3. In particular, these components may extend through a hollow shaft 26 of the machine tool 3. The hollow shaft 26 connects an electric motor 27 of the machine tool 3 to a rotor 37 of the device for magnetizing 20 in a rotationally locked manner. Preferably, the hollow shaft 26 is comprised of portions 28 and 29 fixedly connected to each other.

The portions 28 and 29 of the hollow shaft 26 may be supported, for example by means of ball bearings 30, in housing portions 34 and 35 of the machine tool 3. The portion 28 of the hollow shaft 26 is preferably fixedly connected to a rotor 41 of the electric motor 27, for example by means of bolts 42. The portion 29 of the hollow shaft 26 may be fixedly connected to the rotor 37 at its lower end substantially opposite the portion 28. The portion 7 of the mounting 6 of the device for ultrasonic machining 2 may extend into the lower end 36 of the portion 29 of the hollow shaft 26. The lower end 36 of the portion 29 preferably has a chamfer 45 to assist when inserting the portion 7 of the mounting 6 into the lower end 36. Further, the portion 29 may comprise radial openings 38 that are connected to channels 39 to ventilate the ball bearings 30.

The electric motor 27 also has a stator 46 surrounding the rotor 41. The electric motor 27 is configured to rotate the device for ultrasonic machining 2 about its longitudinal axis 12. Preferably, the electric motor 27 is a "torque motor".

Beside the rotor 37, which has a ring shape and is, for example, made of steel, the device for magnetizing 20 has a coil 43. The coil 43 is fixedly connected to the housing portion 35 and therefore stationary with respect to the rotor 37. In the state shown in the FIGURE where a current passes through the coil 43, the coil 43 generates a magnetic field passing through the rotor 37 as well as the armature 18 of the device for ultrasonic machining 2. The magnetic coupling between the coil 43 as well as the rotor 37 and the armature 18 is further increased due to the coil 43 partially extending into the rotor 37. To this end, a gap 44 in a labyrinth shape is formed between the coil 43 and the rotor 37.

The magnetic field results in the armature 18 being locked to the rotor 37. This locking is well suited to transmit high torques between the electric motor 27 and the sonotrode 4.

When the power supply to the coil 43 is disconnected, the lock between the rotor 37 and the armature 18 is released and the device for ultrasonic machining 2 may be replaced by another device for ultrasonic machining suited to the new task at hand.

Although the present invention has been described with reference to preferred embodiments, it is not restricted thereto but rather can be modified in many ways. The terms "upper" and "lower" have only been used herein to ensure a good understanding of the positions of the components with respect to one another. However, this is not to be construed as a restriction with regard to their positions in absolute terms; when looking at the FIGURE in landscape, the terms "left" and "right" could have been used just as well.

Further, the embodiments of the device for ultrasonic machining described herein may just as well be applied to the machine tool apparatus according to the invention or the machine tool according to the invention, and vice versa.

What is claimed is:

1. A device for ultrasonic machining, comprising:

a sonotrode for machining material; and an armature for connecting the device to a machine tool in a releasably magnetic manner, wherein the device comprises a mounting to which the sonotrode and the armature are mounted, wherein the mounting comprises a flange extending substantially radially in relation to a longitudinal axis of the sonotrode to which the armature is mounted, wherein the mounting is formed with a through-hole through which the sonotrode extends at least partially and wherein the armature is formed as a ring of magnetizable material to release the device for ultrasonic machining from the machine tool and, when magnetized to fixedly connect the device for ultrasonic machining to the machine tool, wherein the armature is fixedly connected to the flange of the mounting.

2. The device according to claim 1, wherein the device further comprises a transducer being connectable to a power supply at the machine tool to receive electrical energy and being connected to the sonotrode for inducing mechanical vibrations into the sonotrode, wherein the transducer is configured to convert the electrical energy into mechanical energy.

3. The device according to claim 1, wherein a transducer is arranged outside the through-hole.

4. A machine tool being connectable to the device for ultrasonic machining according to claim 1 in a releasably magnetic manner.

5. The machine tool according to claim 4, wherein the machine tool has a stationary device for magnetizing and a rotable rotor, wherein the rotor is configured for contacting the anchor of the device for ultrasonic machining and the device for magnetizing is configured to magnetize the rotor and the armature for connecting these to each other.

6. The machine tool according to claim 5, wherein the device for magnetizing comprises a coil.

7. The machine tool according to claim 5, wherein a gap in the form of a labyrinth is fanned between the coil and the rotor.

8. The machine tool according to claim 5, wherein the rotor is connected to a shaft for rotating the device for ultrasonic machining in a rotationally locked manner.

9. The machine tool according to claim 8, wherein the shaft is connected to a driving device for driving the shaft.

10. A machine tool apparatus, comprising a machine tool according to claim 4 and a device for ultrasonic machining according to claim 1, wherein the machine tool and the device for ultrasonic machining are connected to each other in a releasably magnetic manner.

* * * * *